US005327687A

United States Patent [19]

Hsieh

[11] Patent Number: 5,327,687

[45] Date of Patent: Jul. 12, 1994

[54] APPARATUS FOR CONTINUOUSLY GRINDING A CURVED PLATE

[75] Inventor: Yu-An Hsieh, Kaohsiung City, Taiwan

[73] Assignee: Metal Industries Research & Development Centre, Kaohsiung City, Taiwan

[21] Appl. No.: 107,299

[22] Filed: Aug. 16, 1993

[51] Int. Cl.[5] ..... B24B 49/00

[52] U.S. Cl. ..... 51/165.71; 51/165.77; 51/215 E; 29/564

[58] Field of Search ..... 51/165.71, 165.77, 80 A, 51/81 R, 90, 215 E, 326; 29/33 P, 35.5, 38 A, 564

[56] References Cited

U.S. PATENT DOCUMENTS 2,110,931 3/1938 Dyer et al. ..... 51/215 E
2,205,628 6/1940 Morrison ..... 51/215 E
3,955,258 5/1976 Flisch ..... 29/564
4,301,581 11/1981 Bader et al. ..... 29/564

FOREIGN PATENT DOCUMENTS 0129752 2/1978 Fed. Rep. of Germany .... 51/215 E

*Primary Examiner*—M. Rachuba
*Attorney, Agent, or Firm*—Darby & Darby

[57] ABSTRACT

A grinding apparatus includes an upright casing with a plurality of horizontal mounting frames and a worm journalled between a top and bottom of the upright casing. Several grinding devices are respectively mounted on each of the mounting frames and can perform different grinding operations. Each of the grinding devices is connected to the worm via transmission devices. Axial rotation of the worm correspondingly moves the grinding devices in order to complement with a radius of curvature of the curved plate that is fed to the apparatus.

5 Claims, 17 Drawing Sheets

APPARATUS FOR CONTINUOUSLY GRINDING A CURVED PLATE

BACKGROUND OF THE INVENTION

FIELD OF INVENTION

The invention relates to a grinding apparatus, more particularly to an apparatus for grinding continuously a plurality of curved plate.

DESCRIPTION OF THE RELATED ART

FIG. 1 shows a curved plate (X) which is to be used as a lining plate in the manufacture of a brake shoe of an automobile. As best illustrated, the curved plate (X) possesses a concave face (B), a convex face (A) and two beveled faces (C) which interconnect the concave and convex faces (A, B). Different grinding operations are performed in order to form the concave face (B), the convex face (A) and the two beveled faces (C).

Until now, the different grinding for forming the concave, convex and beveled faces on workpieces are done manually with the use of different grinding devices. Thus, a relatively long processing time and a large amount of manpower are required. In addition, the dust which results from the grinding operations can affect the health of operators of the different grinding devices.

SUMMARY OF THE INVENTION

Therefore, a main objective of the present invention is to provide an apparatus for grinding continuously a curved plate, which apparatus does not require a large amount of manpower.

A second objective of the present invention is to provide an apparatus which includes a hollow upright casing and a plurality of grinding devices respectively mounted on different mounting frames of the upright casing so that grinding processes of concave, convex and beveled faces on the workpiece can be done continuously within the upright casing, so that the dust which results from the grinding operations is collected within the upright casing.

A third objective of the present invention is to provide an apparatus which has a synchronous adjusting mechanism mounted in the upright casing and connected to each of the grinding units so as to adjust the grinding units in order to effect grinding of different workpieces with differing radii of curvature.

A fourth objective of the present invention is to provide an apparatus which is compact so that it requires a relatively small amount of space to install the apparatus.

According to the present invention, the apparatus includes an upright casing that has a synchronous adjusting worm journalled between a top and bottom of the upright casing, a feeding device mounted on a first mounting frame adjacent to the top, first and second horizontal transferring devices and a first grinding device mounted on a second mounting frame below the first mounting frame, third and fourth horizontal transferring devices and a second grinding device mounted on a third mounting frame below the second mounting frame, an impelling mechanism that includes a fifth horizontal transferring device and an air cylinder mounted on the fourth mounting frame below the third mounting frame, and a chamfering device mounted on a fifth mounting frame below the fourth mounting frame. The first grinding device can perform a grinding action on a workpiece to provide a concave face thereon. The second grinding device can form a convex face on the workpiece, and the chamfering device can form beveled faces which interconnect the concave and convex faces and which are located on two distal edges of the workpiece. A first lift device is mounted between the first and second mounting frames and transfers the workpiece to the second mounting frame. The first and second horizontal transferring devices transfer the workpiece into and out of the first grinding device. A second lift device is mounted between the second and third mounting frames. Third and fourth horizontal transferring devices transfer the workpiece into and out of the second grinding device. A third lift device is mounted between the third and fifth mounting frames and transfers the workpiece from the third mounting frame to the chamfering device and later to the fourth mounting frame and then to the third mounting frame. The feeding device, the first, second, third, fourth and fifth transferring devices, the first and second grinding devices and the chamfering device are respectively connected to the synchronous adjusting worm such that an axial rotation of the synchronous adjusting worm can move the grinding devices and the horizontal transferring devices so that relative positions of the grinding devices and the horizontal transferring devices are adjusted in accordance with the radius of curvature of the curved plate which is being fed to the feeding device of the present apparatus.

Since the feeding, grinding and chamfering devices and the horizontal transferring devices are arranged to function continuously, the apparatus does not require a large amount of manpower as in the prior art. The dust that results due to grinding operations can be collected within the upright casing. Thus, the present apparatus can provide a cleaner working environment.

BRIEF DESCRIPTION OF THE DRAWINGS

Other features and advantages of the present invention will become more apparent in the following detailed description of the preferred embodiment with reference to the accompanying drawings, in which.

DETAILED DESCRIPTION OF THE PREFERRED EMBODIMENT

Figure 1:
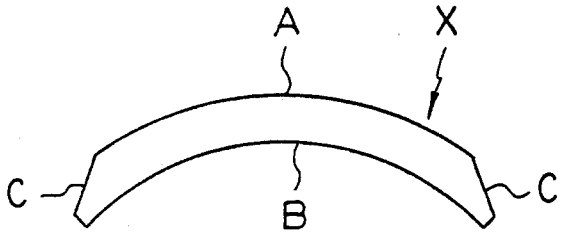
FIG. 1 shows a curved plate which is ground by the grinding apparatus of the present invention.
Figure 2:
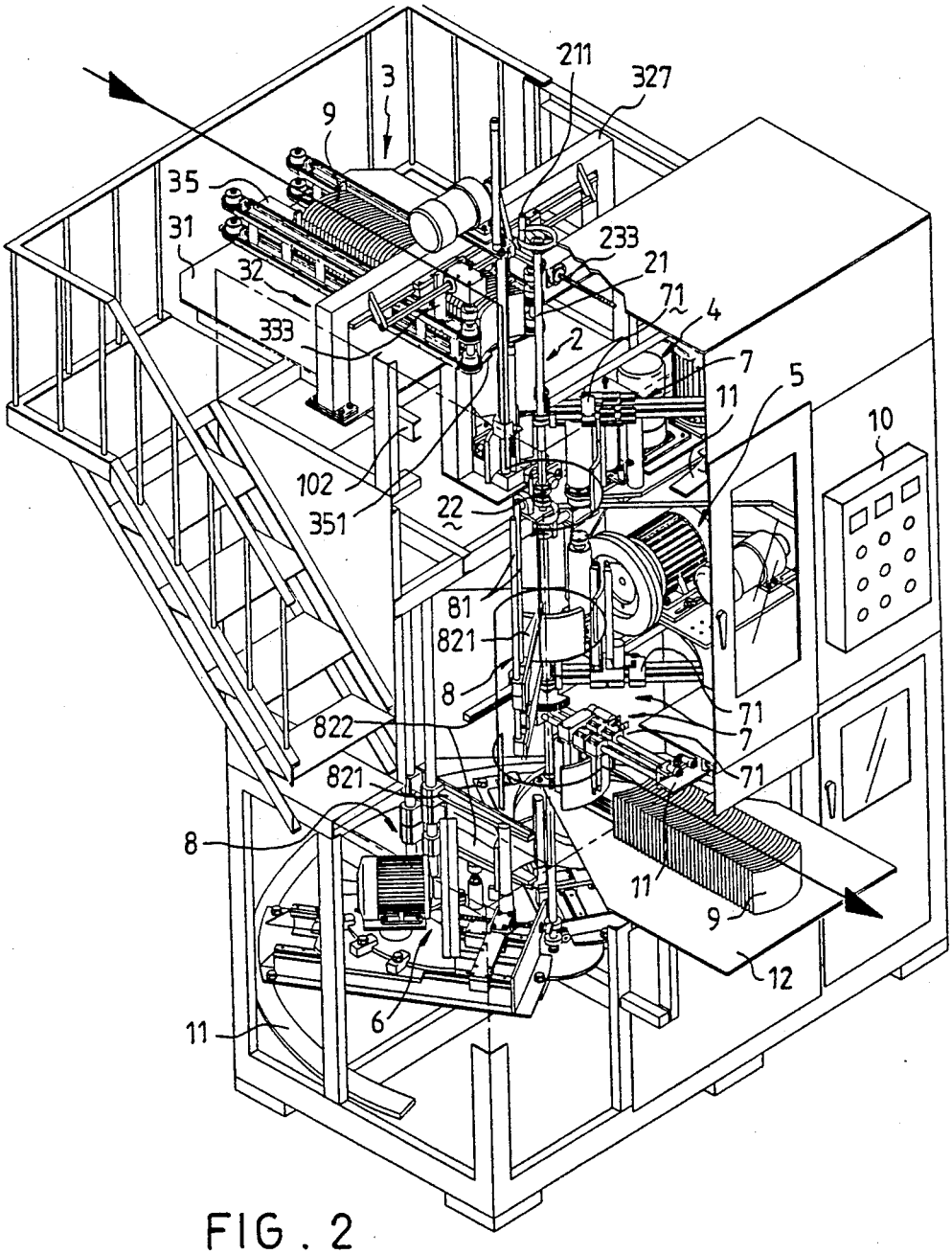
FIG. 2 shows a perspective view of an apparatus according to the present invention for grinding continuously a curved plate, a part of an outer covering of the apparatus being removed to illustrate the interior thereof.
Figure 3:
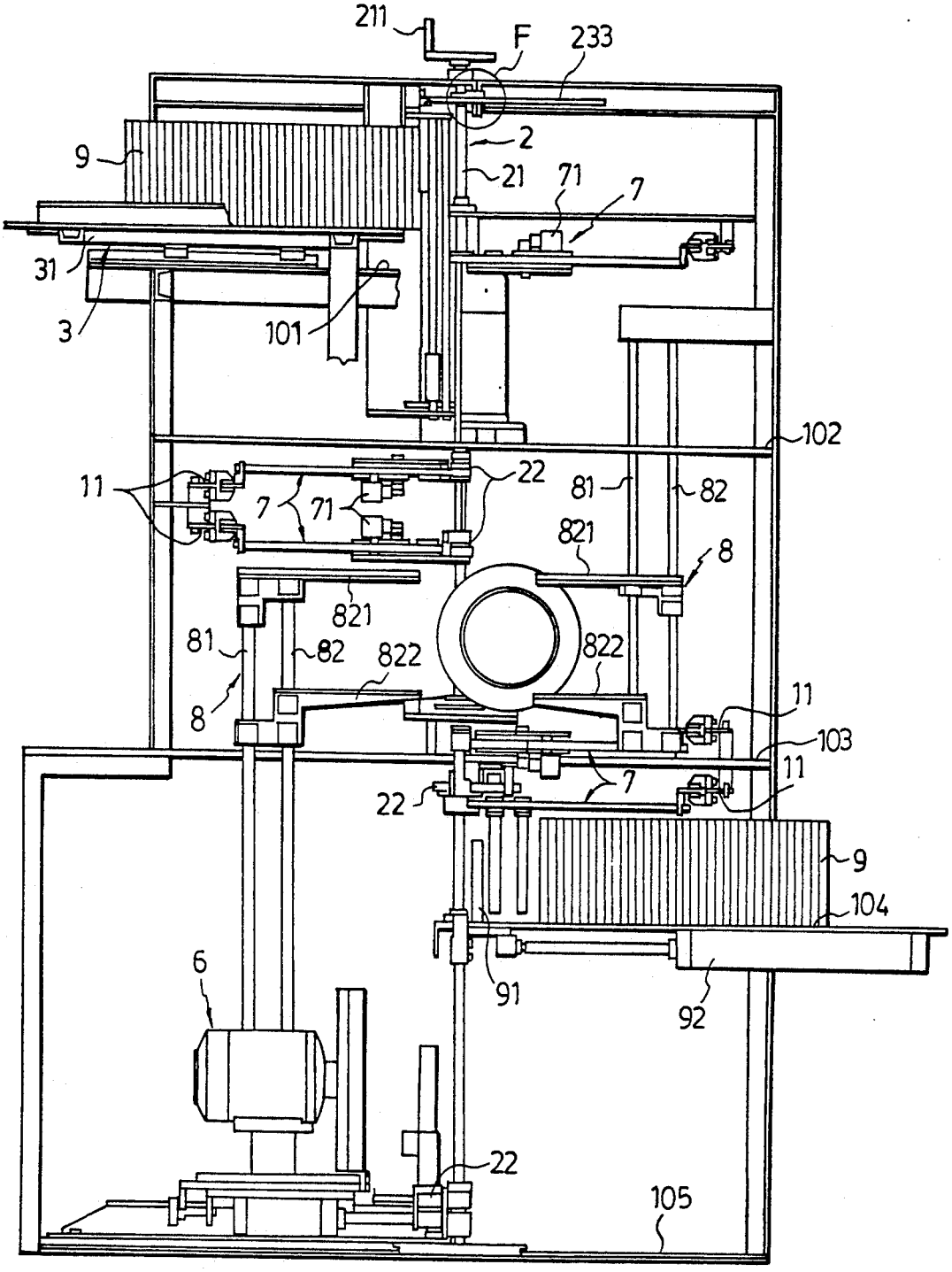
FIG. 3 shows a side view of the apparatus of FIG. 2 without the outer covering.

Before the present invention is described in great detail, it should be noted that like elements are indicated by the same reference numerals throughout the disclosure, Referring to FIGS. 2 and 3, an apparatus for continuously feeding and grinding curved plates in accordance with the present invention is shown to include an upright casing 1 that has a synchronous adjusting mechanism, journalled between a top and bottom of the upright casing, a feeding device 3 mounted on a first mounting frame 101 adjacent to the top, first and second horizontal transferring devices 7 and a first grinding device 4 mounted on a second mounting frame 102, third and fourth horizontal transferring devices 7 and a second grinding device 5 mounted on the third mounting frame 103, an impelling mechanism mounted on the fourth mounting frame 104, and a chamfering device mounted on the fifth mounting frame 105. In this embodiment, the synchronous adjusting mechanism is a worm 21. The second, third and fifth mounting frames 102, 103, 105 respectively have a curved support plate 11 of predetermined curved length thereon.

Figure 7:
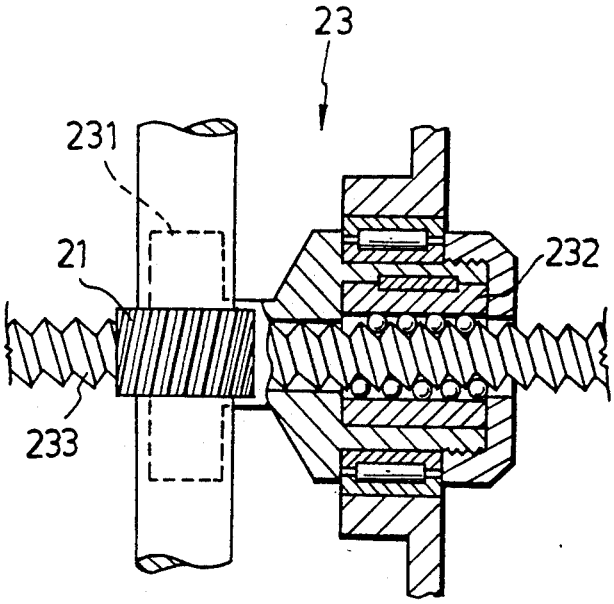
FIG. 7 shows an enlarged view of worm gear illustrated in the circle (F) of FIG. 2.
Figure 9:
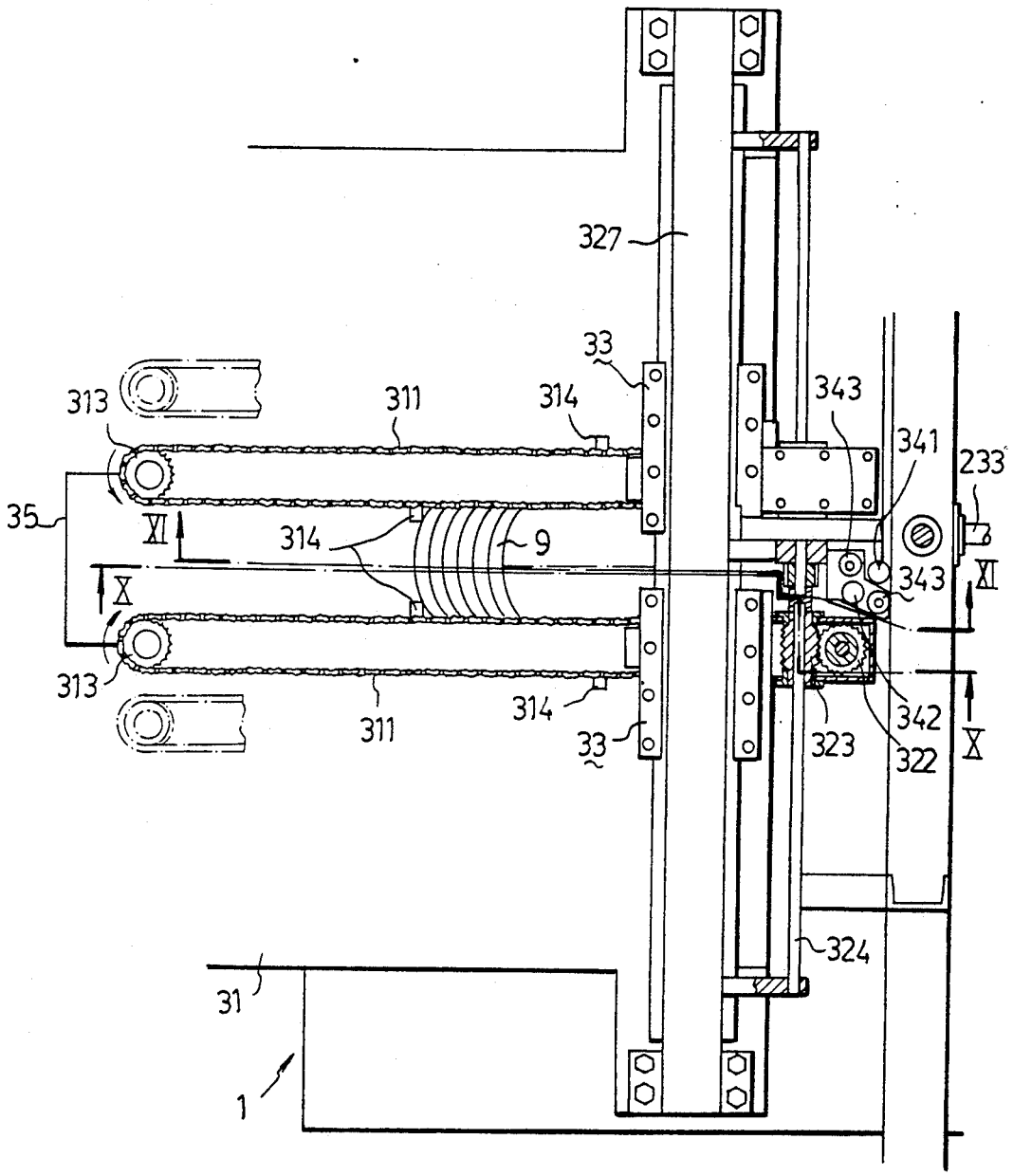
FIG. 9 shows a top view of the feeding device that is employed in the grinding apparatus of the present invention.
Figure 10:
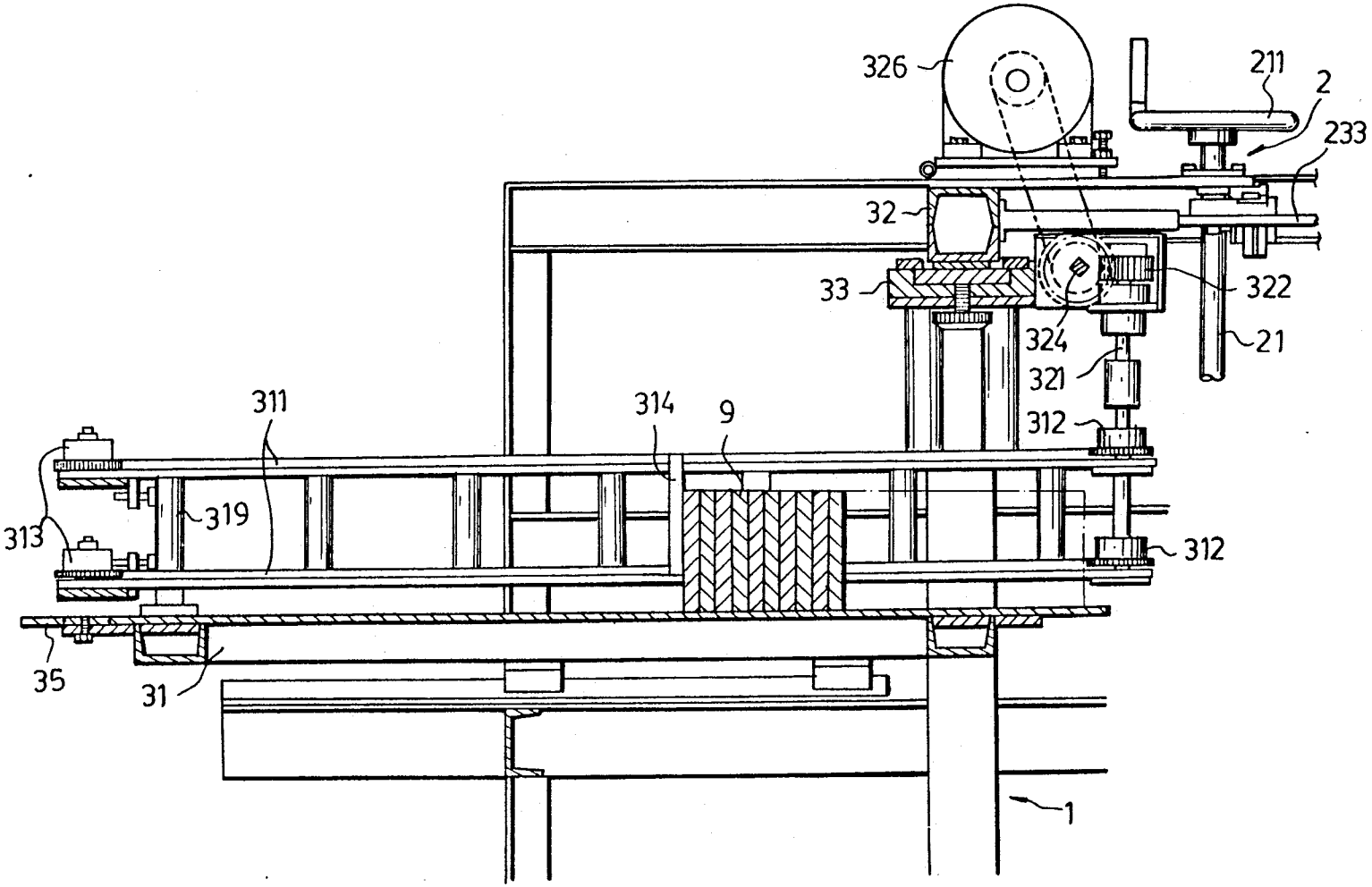
FIG. 10 is a cross sectional view of the feeding device of FIG. 9 taken along the line X—X.

Referring to FIGS. 2, 7 and 9, the feeding device 3 includes a support plate 31 mounted slidably on the first mounting frame 102, an elongated carrier plate 35 connected detachably to the support plate 31 and an inverted U-shaped frame 32 fixed vertically on the support plate 31 such that an intermediate arm 327 of the U-shaped frame 32 is disposed above and transverse to a longitudinal axis of the carrier plate 35. The carrier plate 35 has a first side 351 adjacent to the worm 21 and means for retaining the curved plates 9 vertically on the carrier plate 35 and for pushing the same toward the first side 351 of the carrier plate 35. The first end 351 of the carrier plate 35 is provided with a substantially U-shaped notch 352 (Refer to FIG. 12), the purpose of which will be described in the succeeding paragraph. The retaining and pushing means includes two chain holding units 33 mounted slidably on the intermediate arm 327, a driving shaft 324 which is journalled on the intermediate arm 327 in a parallel manner and which passes through the chain holding units 33, two downwardly extending driven shafts 321 which are connected with the driving shaft 324, and a driving motor 326 mounted above the intermediate arm 327 for rotating the driving shaft 324. The driving shaft 324 has two spaced driving wheels 323 which are fixed thereon and which are disposed inside the chain holding units 33. The driving wheels 323 mesh with a gear wheel 322 on a respective driven shaft 321. Each of the driven shafts 321 respectively have two driven wheels 312. Two vertical stands 319 are erected and are spaced apart on the support plate 31 adjacent to a second side which is opposite to the first side 351 of the support plate 31. Each of the vertical stands have two rotary wheels 313. Each of the two endless chains 311 is trained around the respective driven wheel 312 and the respective rotary wheel 313. Each of the chains 311 has a pushing rod 314 which retains the curved plates 9 vertically on the carrier plate 35 and which pushes the same toward the first side 351 of the carrier plate 35 when the endless chains 311 are rotated. The relative positions of the chain retaining units 33 can be adjusted manually along the intermediate arm 327 in accordance with the size of the curved plate 9. After adjustment, the retaining units 33 are secured on the intermediate arm 327 by means of fastening screws 331.

The feeding device further includes a first worm gear 231, as shown in FIG. 7, which meshes with the worm 21, and a first threaded shaft 233 which passes threadedly through a threaded portion 232 that is formed in the intermediate arm 327 of the U-shaped frame 32 so that the carrier plate 35 and the U-shaped frame 32 will move relative to the worm 21 when the latter is rotated. The first side 351 of the carrier plate 35 moves when the worm 21 is rotated so as to be spaced from the worm 21 by a first predetermined distance which is equal to the radius of curvature of the curved plate 9.

Figure 11:
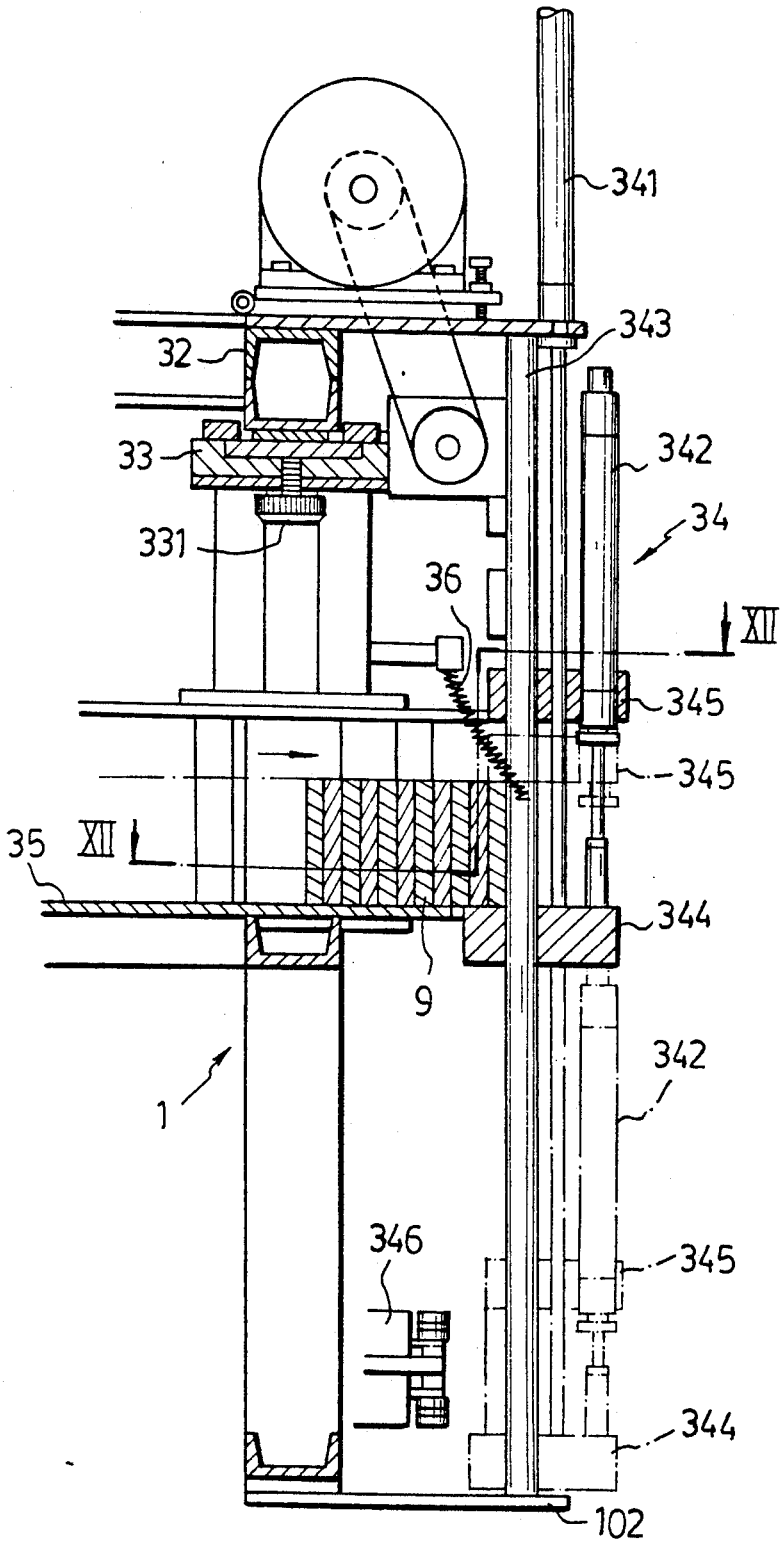
FIG. 11 is a cross sectional view of the feeding device of FIG. 9 taken along the line XI—XI.

Referring to FIG. 11, a first lift device 34 includes two vertical rods 343, each of which having an upper end fixed securely to the intermediate arm 327 of the U-shaped frame 32, a lower end which terminates adjacent to the second mounting frame 102, two clamping units 344, 345 mounted slidably on the vertical rods 343, two air cylinders 341, 342 connected to a respective clamping unit 344, 345, and an actuating means, such as a driving device for actuating the air cylinders 341, 342 relative to one another so as to move synchronously along the vertical rods 343. The substantially U-shaped notch 352 should be sufficiently wide to permit entry of the clamping unit 344 thereinto so as to receive the curved plate 9 during an upward movement of the clamping unit 344. The other clamping unit 345 moves downward together with the former one so as to clamp and transfer the curved plate 9 to a first predetermined position on the second mounting plate 102. The feeding device further includes a resilient means 36, such as a spring, which retains a succeeding one of the curved plates 92 to stand vertically in cooperation with the push rod 314 of the endless chain members 311 on the carrier plate 35 adjacent to a preceding curved plate which is located across the U-shaped notch 352. Thus, only one curved plate will be transferred by the first lift device at one time.

Figure 12:
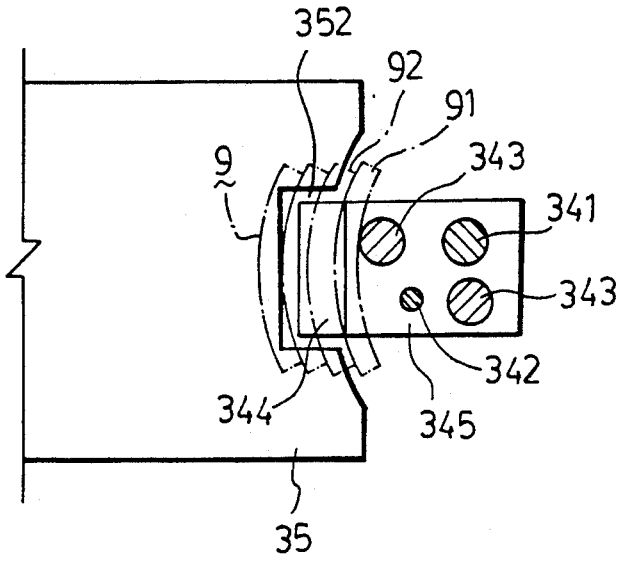
FIG. 12 is a cross sectional view of the feeding device of FIG. 11 taken along the line XII—XII.

Referring to FIG. 12, the present apparatus also includes a detection unit (not shown) located adjacent to the second mounting frame 102 that has a push roller 346 which is capable of pushing the curved plate 9 that is being transferred by the first lift device 34 so as to protrude by a greater section out of the clamping units 344, 345 to facilitate a clamping operation by a horizontal transferring device. This action takes place upon detection that an exposed section of the curved plate 9 which is transferred by the first lift device 34 is insufficient to provide firm grip by the horizontal transferring device.

Figure 13:
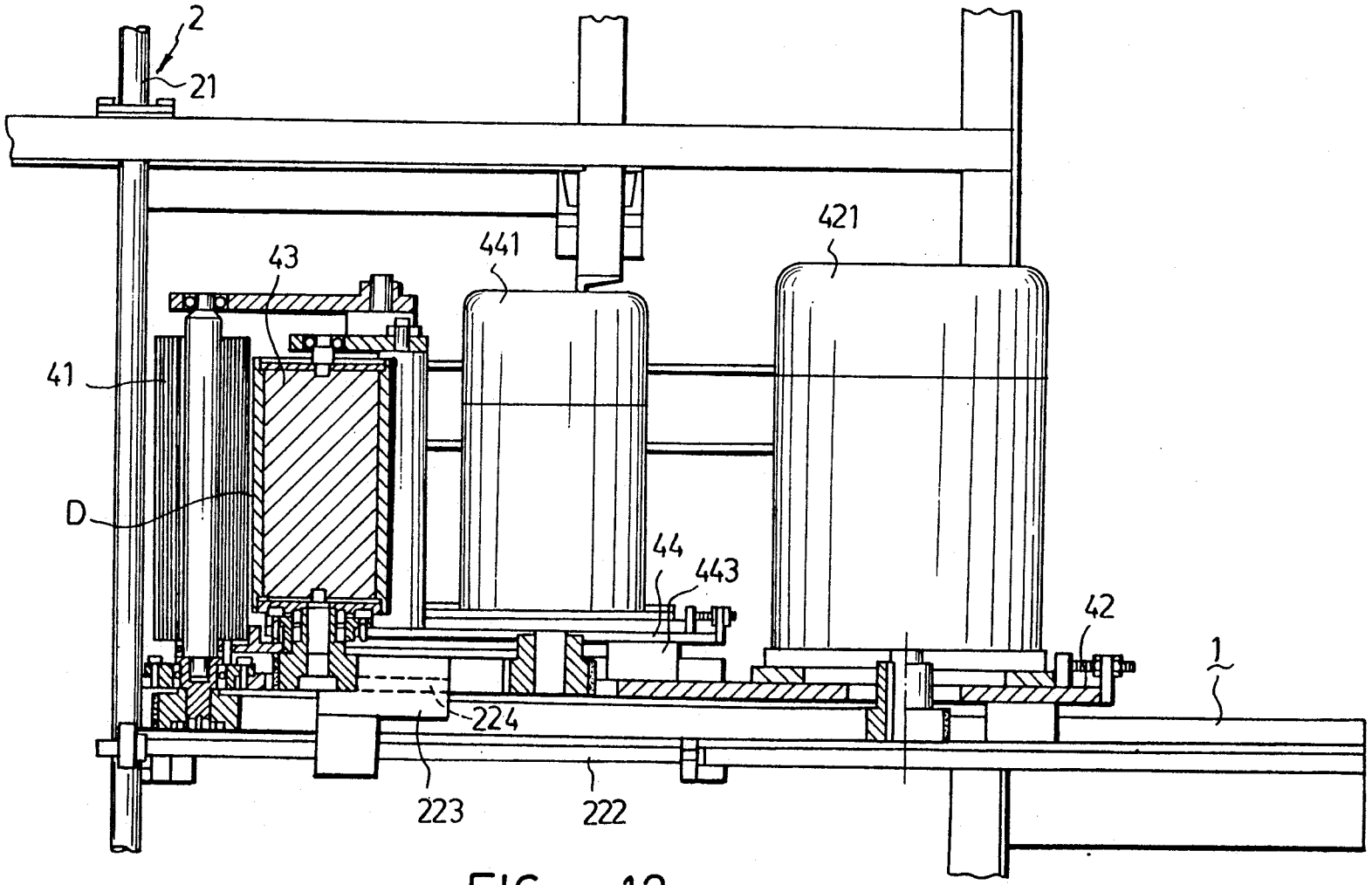
FIG. 13 is a side view of a first grinding device that is employed in the grinding apparatus of the present invention.
Figure 14:
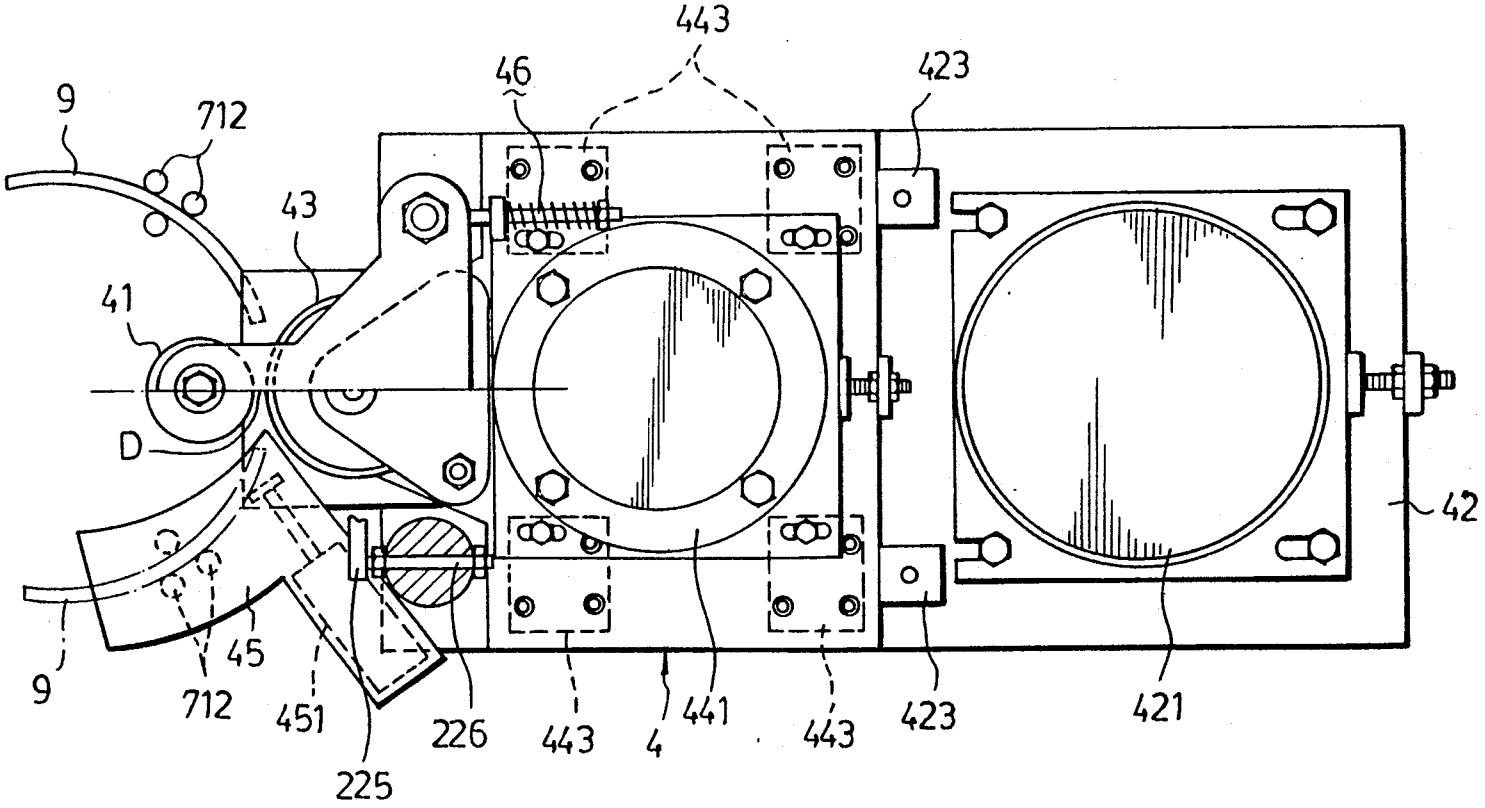
FIG. 14 shows a top view of the first grinding device of FIG. 13.

Referring to FIGS. 13 and 14, the first grinding device includes an elongated first main support 42 which has two longitudinal grooves 423 that extend across an entire length thereof, and a first secondary support 44 which has a plurality of downwardly extending slide projections 443 that are received in the longitudinal groove 423 such that the first secondary support 44 can slide on the first main support 42. The first main support 42 has a first grinding member 41 mounted rotatably thereon. The first secondary support 44 has a first press member 43 mounted rotatably thereon. A first biasing member 46 biases the first press member 43 toward the first grinding member 41 and maintains the latter at a first clearance (D) relative to the former. Each of the first grinding and press members 41, 43 has a center which lies on the longitudinal axis of the first main support 42. Actuating means, such as motors 421, 441, are used to actuate the first grinding and press members 41, 43.

An important aspect to be observed is that the first clearance (D) should be slightly smaller than the thickness of the curved plate 9 being sent thereinto.

Figure 6:
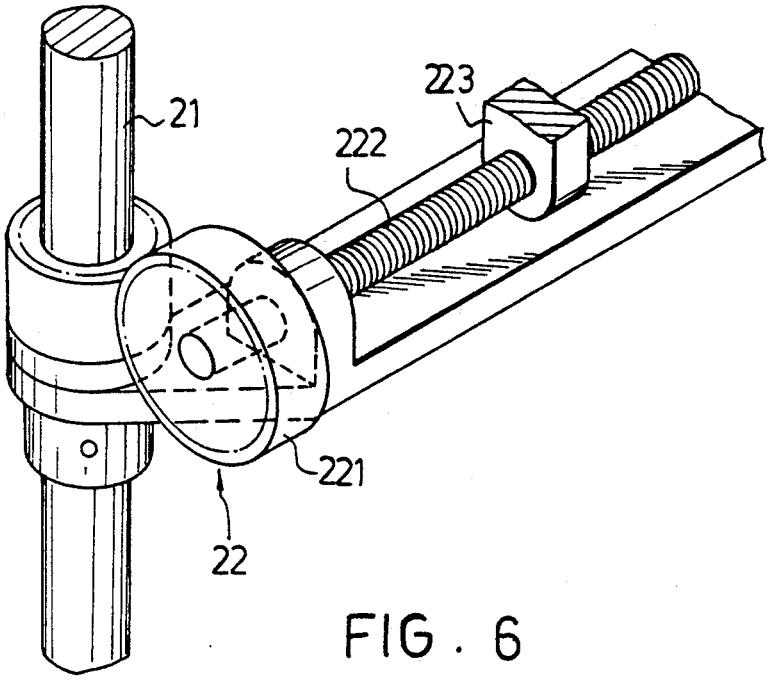
FIG. 6 shows an enlarged view of a worm gear which is used to connect the feeding and grinding devices to a synchronous adjusting mechanism of the apparatus according to the present invention.

The first grinding device further includes a second worm gear 22, as shown in FIG. 6, which meshes with the worm 21, and a second threaded shaft 222 which extends parallel to the first main support 42 and which has a first end that is connected to a center of the second worm gear 22 and a second end that passes threadedly through a first mounting block 223. The first mounting block 223 has an elongated groove 224 to receive the first main support 42, a protrusion portion 225, and a locking screw 226 which passes through the protrusion portion 225 of the first mounting block 223 so as to fasten a cylindrical rod of the first main support 42. In the event that the first clearance (D) becomes wider during the continuous grinding operation, the position of the first press member 43 relative to the first grinding member 41 can be adjusted so as to maintain the first clearance (D) by loosening the locking screw 226 in order to permit sliding movement of the first main support 42 along the groove 224 of the first mounting block 223. Under these conditions, the first main support 42 can move relative to the first mounting block 42 along the second threaded shaft 222. After assembly, a first length is formed between the middle of the first clearance (D) and the axis of the worm 21, which first length is equal to the first predetermined distance. An air cylinder 451 is mounted on the first main support 42 at a first side of the main support 42. The first grinding device expels the curved plate toward the first side of the first main support 42. The cylinder 451 has a piston arm which carries an inverted L-shaped plate 45. The cylinder 451 can be arranged by a known art to extend out of the inverted L-shaped plate 45 at a predetermined interval so as to provide a temporary support for the curved plate 9 that is expelled from the first grinding device 4 before being transferred to the second predetermined position of the second mounting frame 102 by the second horizontal transferring device. The piston arm retracts into the cylinder 451 after the second horizontal transferring device pivots relative to the worm 21.

The second horizontal transferring device transfers the curved plate 9 from the first predetermined position of the second mounting frame 102 into the first grinding device 4. The second horizontal transferring device then transfers the curved plate 9 from the first grinding device to a second predetermined position of the second mounting frame 102. The construction of the horizontal transferring devices will be described in the succeeding paragraphs.

Figure 15:
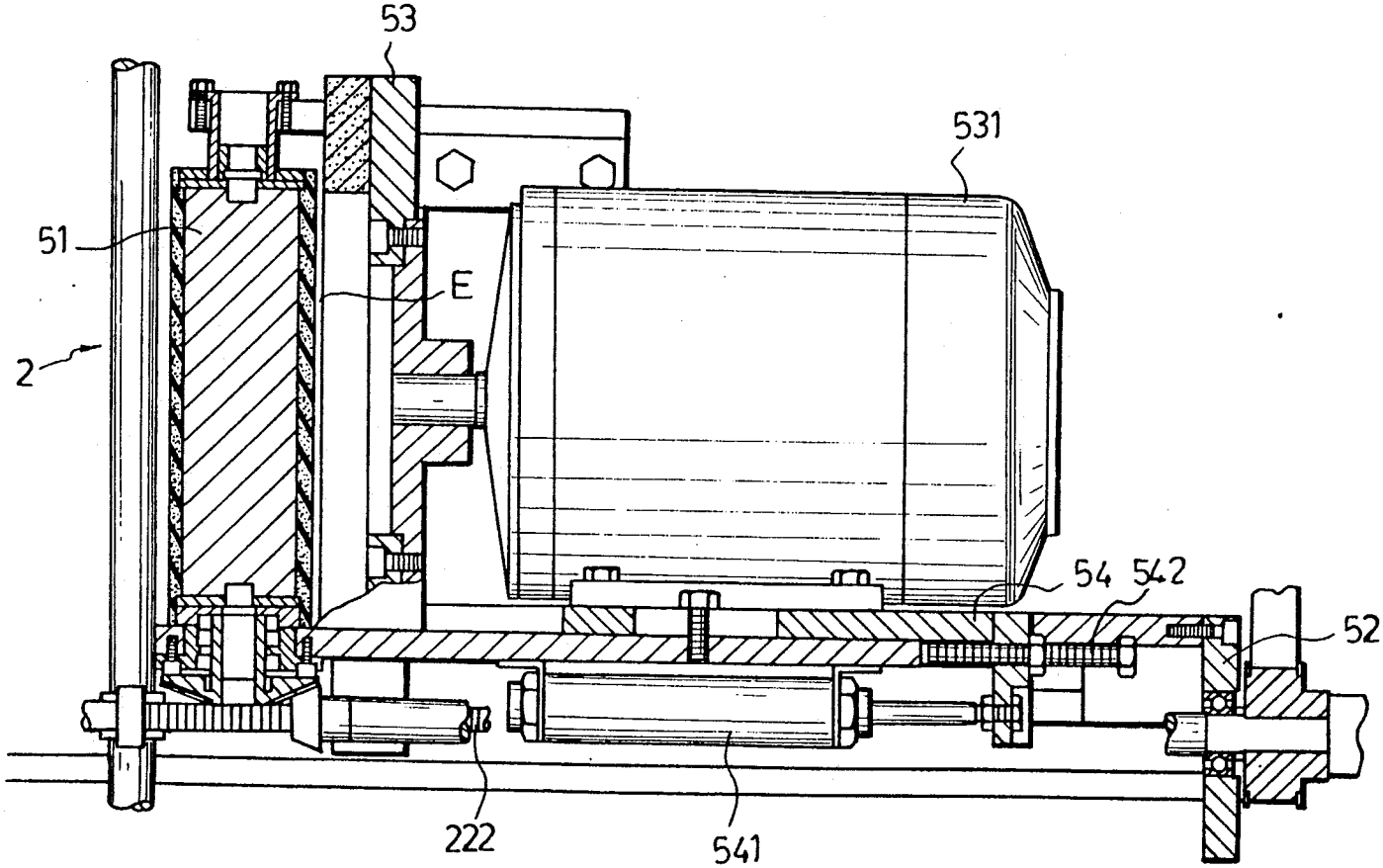
FIG. 15 shows a side view of a second grinding device that is employed in the grinding apparatus of the present invention.
Figure 16:
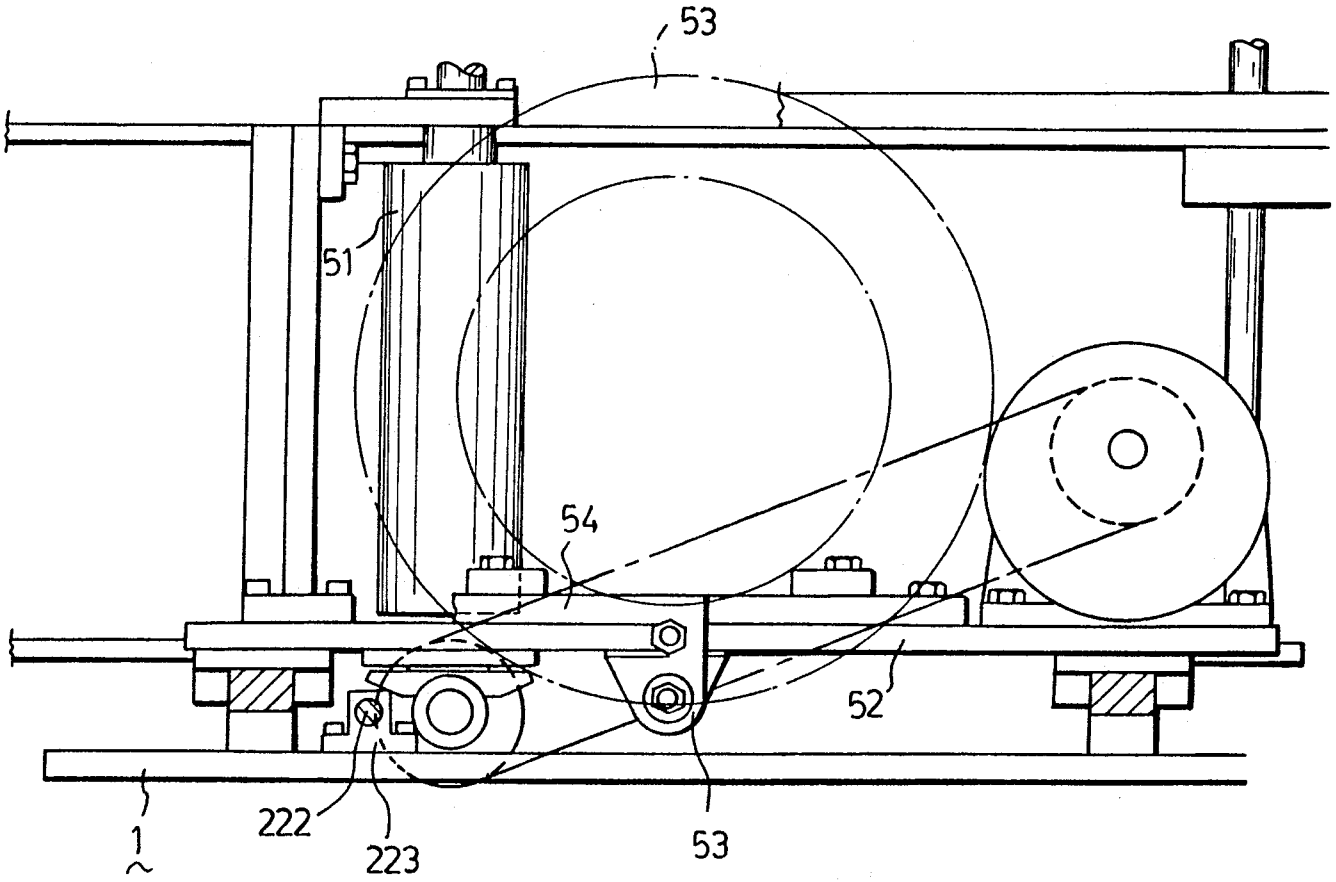
FIG. 16 shows a top view of the second grinding device of FIG. 15.

Referring to FIGS. 15 and 16, the second grinding device 5 includes a second main support 52 that has a second press member 51 mounted rotatably thereon and a second secondary support 54 that is mounted slidably on the second main support 52 and that has a second grinding member 53 mounted rotatably thereon and a second biasing member. In this embodiment an adjustable screw 542 is used to maintain the second grinding member 53 at a second clearance (E) relative to the second press member, the second clearance (E) being slightly smaller than the thickness of the curved plate 9 that is being fed therein. The second grinding member 53 and the second press member 51 are connected to one another by a known transmission means and are rotated by an actuating means, such as a motor 531, so that each of which rotates in opposite directions in order to permit the curved plate 9 to enter therebetween. The second clearance (E) can be altered if desired by a method similar to that used in the first grinding device 4.

The second grinding device 5 further includes a third worm gear 22 that meshes with the worm 21, and a third threaded shaft 222 that has a first end which is connected to the third worm gear 22 and a second end which passes threadedly through a second mounting block 223 in a manner similar to the first grinding device 4 so that a second length is formed between the middle of the second clearance (E) and the axis of the worm 21, which second length is equal to the first predetermined distance.

A second lift device 8 is mounted between the second and third mounting frames 102, 103 and transfers the curved plate 9 from the second predetermined position of the second mounting frame 102 to a third predetermined position of the third mounting frame 103. The second lift device 8 includes two vertical rods 81, 82 with two clamping units 821, 822 mounted slidably on the vertical rods 81, 82 and actuating means, such as air cylinders to drive the clamping units 821, 822 axially on the vertical rods 81, 82. The second lift device 8 functions in the same way as the first lift device 34.

The construction of the third and fourth horizontal transferring devices are the same as that of the first horizontal transferring device, which will be described hereinafter. The third horizontal transferring device transfers the curved plate 9 from the third predetermined position of the third mounting frame 103 to the second grinding device 5, while the fourth horizontal transferring device transfers the curved plate 9 from the second grinding device 5 to the fourth predetermined position of the third mounting frame 103.

The second driving device 5 further includes an air cylinder similar to that one of the first grinding device and provides temporary support for the curved plate 9 that is expelled from the second grinding device 5 and that is to be transferred by the pivotal action of the fourth horizontal transferring device.

The impelling mechanism includes a fifth horizontal transferring device, the structure of which is the same as the first horizontal transferring device, a push means, such as an air cylinder, and an actuating means for moving the push means.

A third lift device 8 is mounted between the third and fifth mounting frames 103, 105 so as to transfer the curved plate 9 from the fourth predetermined position of the third mounting frame to the chamfering device 6. Since the structure of the third lift device is similar to that of the second lift device, a detail description thereof will not be provided herein.

Figure 17:
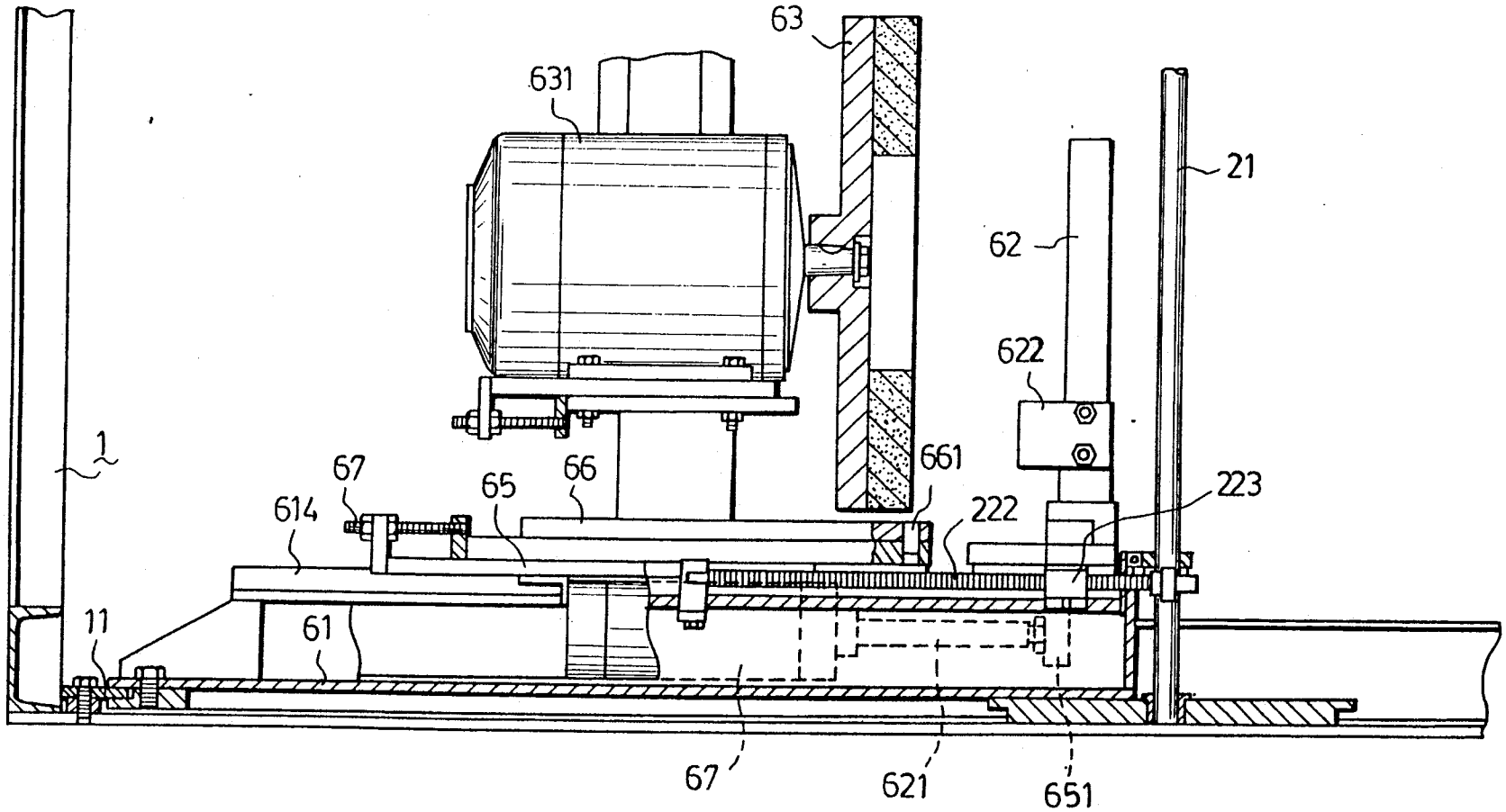
FIG. 17 shows a side view of a chamfering device that is employed in the grinding apparatus of the present invention.
Figure 18:
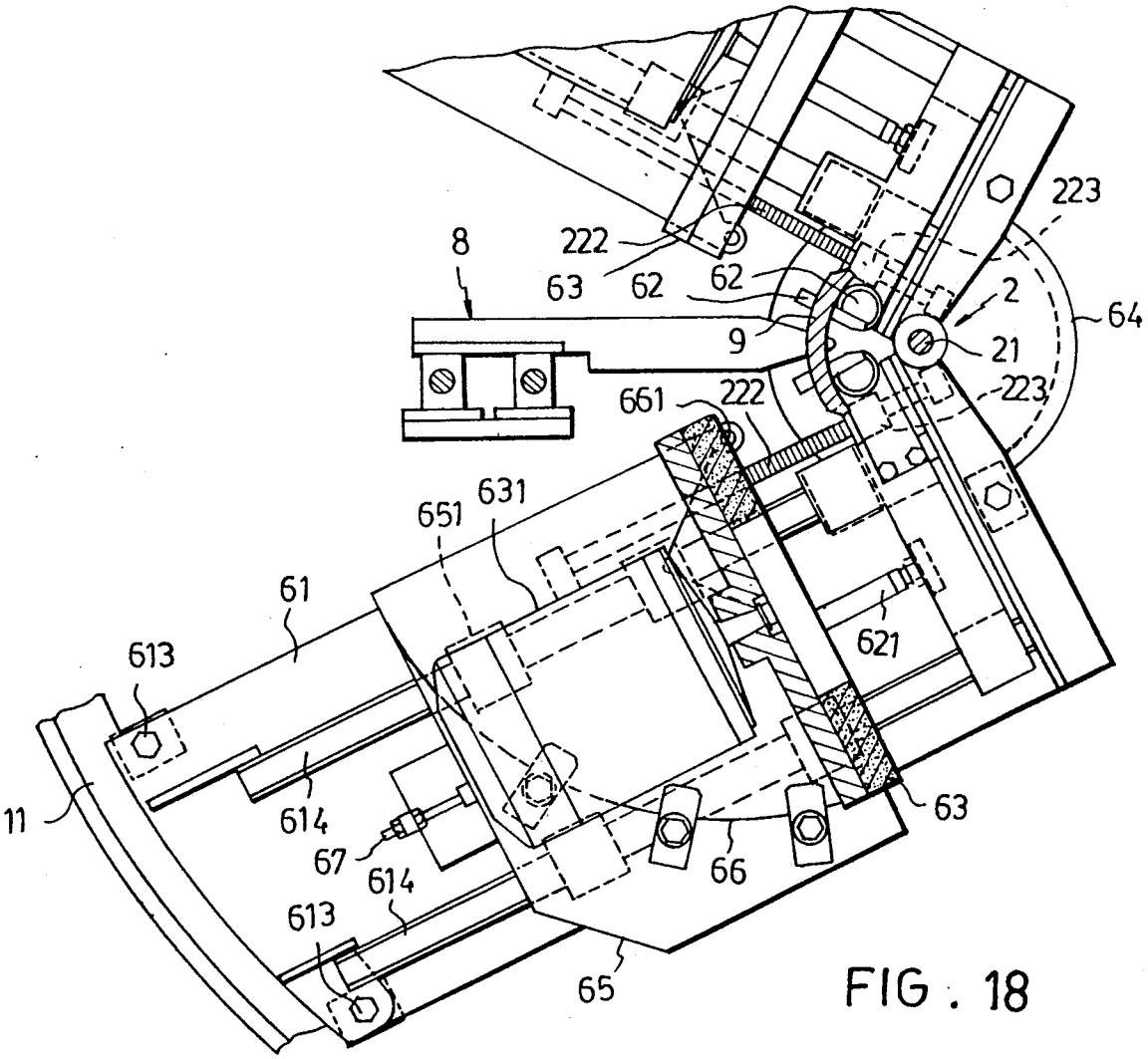
FIG. 18 shows a top view of the chamfering device shown in FIG. 17.
Figure 19:
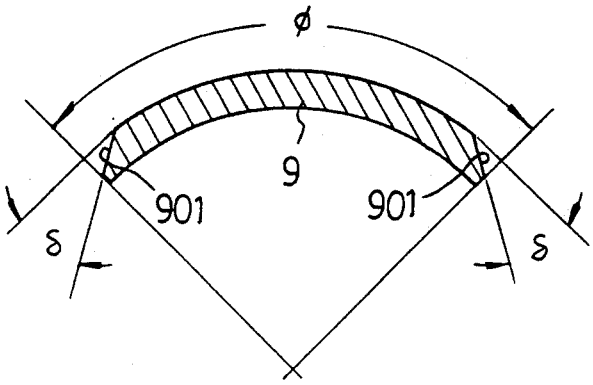
FIG. 19 sows a horizontal section of a workpiece which is ground by the chamfering device of the present apparatus.

Referring to FIGS. 17 and 18, the chamfering device includes a circular base disc 64 mounted on the fifth mounting frame 105 such that the worm 21 extends through the center of the circular base disc 64, and two elongated support plates 61, each of which having a front end pivoted to the circular base disc 64 adjacent to the worm 21 and a rear end fixed detachably on the curved support plate 11 of the fifth mounting frame 105 by means of an adjustable screw 613, thereby defining a first predetermined angle $\phi$ between the support plates 61. The angle $\phi$ corresponds to an angle between two distal edges of the curved plate 9. Each of the support plates 61 has a guiding means, such as two parallel grooves 614 which extend between the front and rear ends thereof, a vertical rod support 62 mounted slidably in the respective groove 614, a holding member 65 which has slide projections 651 that are received in the groove 614 of the support plate 61 and which is disposed between the vertical rod support 62 and the rear end of the elongated support plate 61, and a retractable shaft, such as an air cylinder 621, which interconnects and drives the vertical rod support 62 and the holding member 65 toward or away from each other. The holding member 65 has a vertical pivot post 661 fixed thereon. A rotatable seat 66 is pivoted to a pintle 661 and has a third grinding member 63 mounted rotatably thereon. The rotatable seat 66 can be pivoted manually relative to the pintle 661 so as to dispose the third grinding member 63 at a second predetermined angle $\delta$ relative to a longitudinal axis of the support plate 61 so as to form beveled faces 901 on the respective distal edges of the curved plate 9.

The chamfering device further includes a load carrying plate 622 which extends perpendicularly from the vertical rod support 62 and which has a support face that is aligned vertically with the fourth predetermined position of the third mounting frame 103. The chamfering device further includes a fourth worm gear 221 which meshes with the worm 21 and a fourth threaded shaft 222 which is parallel to the support plate 61 and which has a first end that is connected to the fourth worm gear 221 and a second end that is connected threadedly to a mounting block 223. Since the mounting block 223 is fastened to the vertical rod support 62 underneath the load carrying plate 622, the vertical rod support 62 and the holding member 65 will move together relative to the worm 21 when the latter is rotated. Under this arrangement, the load carrying plate 622 is spaced relative to the axis of the worm 21 by the first predetermined distance. The air cylinder member 621 moves the holding member 65 reciprocatingly toward and away from the vertical rod 622 such that the third grinding member 63 moves correspondingly toward and away from the vertical rods 622.

Figure 8:
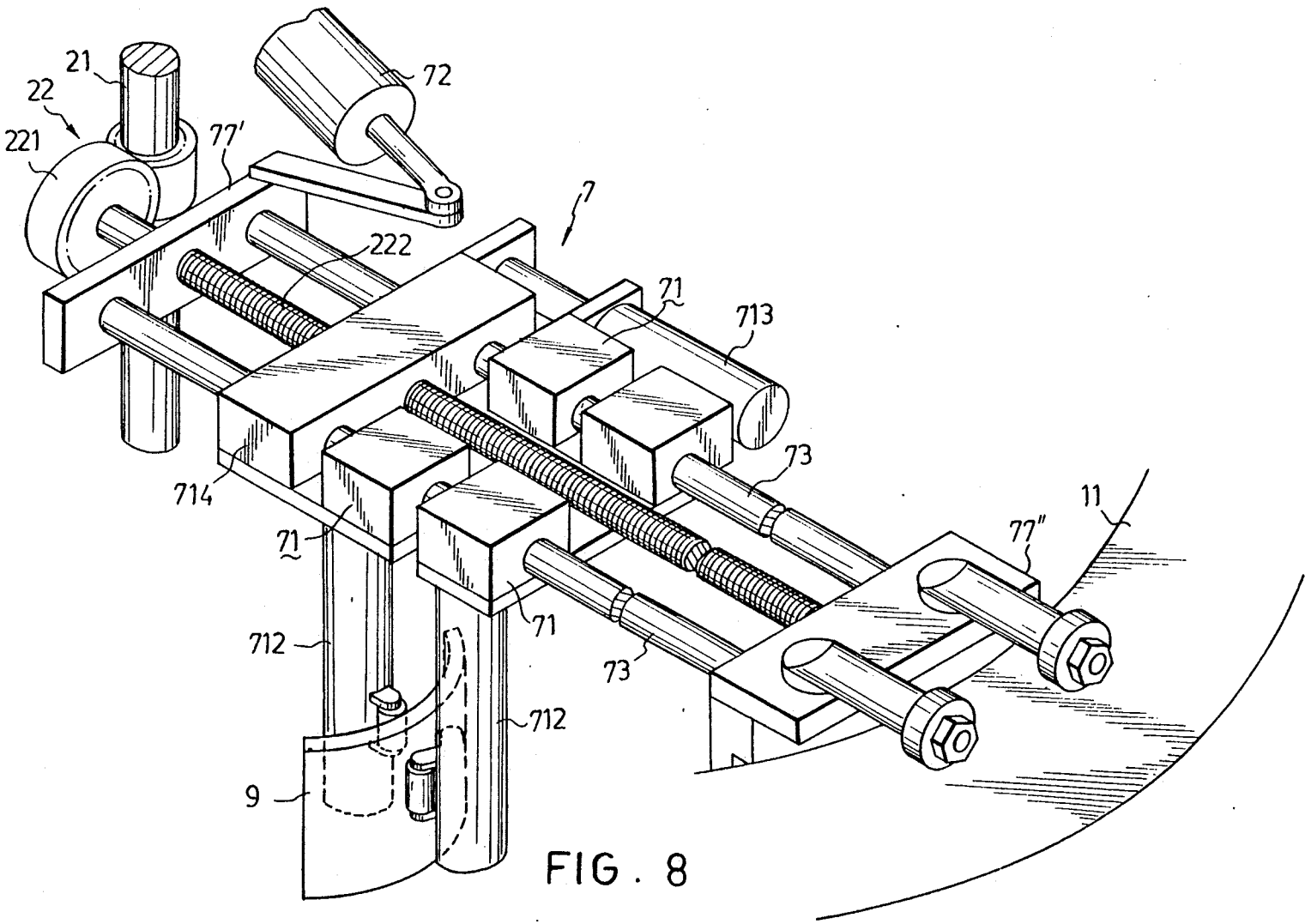
FIG. 8 shows an enlarged view of a horizontal transferring device that is employed in the present apparatus.

Referring to FIG. 8, each of the first, second, third, fourth and fifth horizontal transferring devices includes a fifth worm gear 221 which meshes with the worm 21, a fifth threaded shaft 222 which has a first end fixed to a center of the fifth second worm gear 221 and a second end, and an elongated frame 7 which is parallel to the fifth threaded shaft 222 and which has a front end 77' adjacent to the worm 21. The fifth threaded shaft 222 passes through the elongated frame 7. A rear end 77" of the elongated frame 7 is supported slidably on the respective curved support plate 11 of the mounting frame so that the fifth threaded shaft 222 can pivot about the worm 21. The elongated frame 7 further has two connecting rods 73 which interconnect the front and rear ends 77', 77" of the same, and first and second clamping members 71 which are mounted slidably on the connecting rod 73 and which cooperatively define a gap therebetween. A connecting member 714 is mounted slidably on the connecting rods 73 between the front end of the elongated frame 7 and the clamping members 71. The connecting member 714 is fastened securely to the first clamping member 71 while the fifth threaded shaft 222 passes threadedly through the connecting member 714 so that the connecting member 714 can move along the fifth threaded shaft 222 when the worm 21 rotates. A driving device 713, such as an air cylinder 713, interconnects and drives the clamping members 71 toward and away from one another. After the elongated frame 7 has been assembled, a third length is formed between a middle of the gap and the axis of the worm 21. The third length is equal to the radius of curvature of the curved plate which is fed in the feeding device. An actuating means, such as an air cylinder 72 swings the elongated frame 7 to and fro about the worm 21 in order to transfer the curved plate 9 from one position to another.

Note that during the reciprocating movement of the elongated frame 7 relative to the worm 21, the worm gear 221 moves relative to the worm 21 and correspondingly causes slight movement of the clamping members 71. Since the fifth worm gear 221 meshes with the worm 21 in a high gear ratio, a slight movement of the clamping members 71 does not affect the clamping effects.

In use, the chain holding members 33 of the feeding device 3 are adjusted manually in accordance with the two distal edges of the curved plates 9 so as to receive properly the latter on the carrier plate 35.

Figure 4:
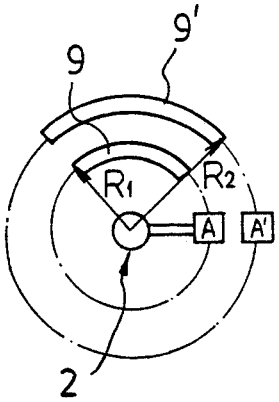
FIG. 4 shows a top view of a part of the grinding apparatus of FIG. 2.

FIG. 4 illustrates two curved plates with different radii of curvature (R1, R2). The worm 21 is rotated manually in advance so as to alter the first predetermined distance to fit with the radius (R1 or R2) of curvature of the curved plates that are to be fed in the feeding device 3.

Figure 5:
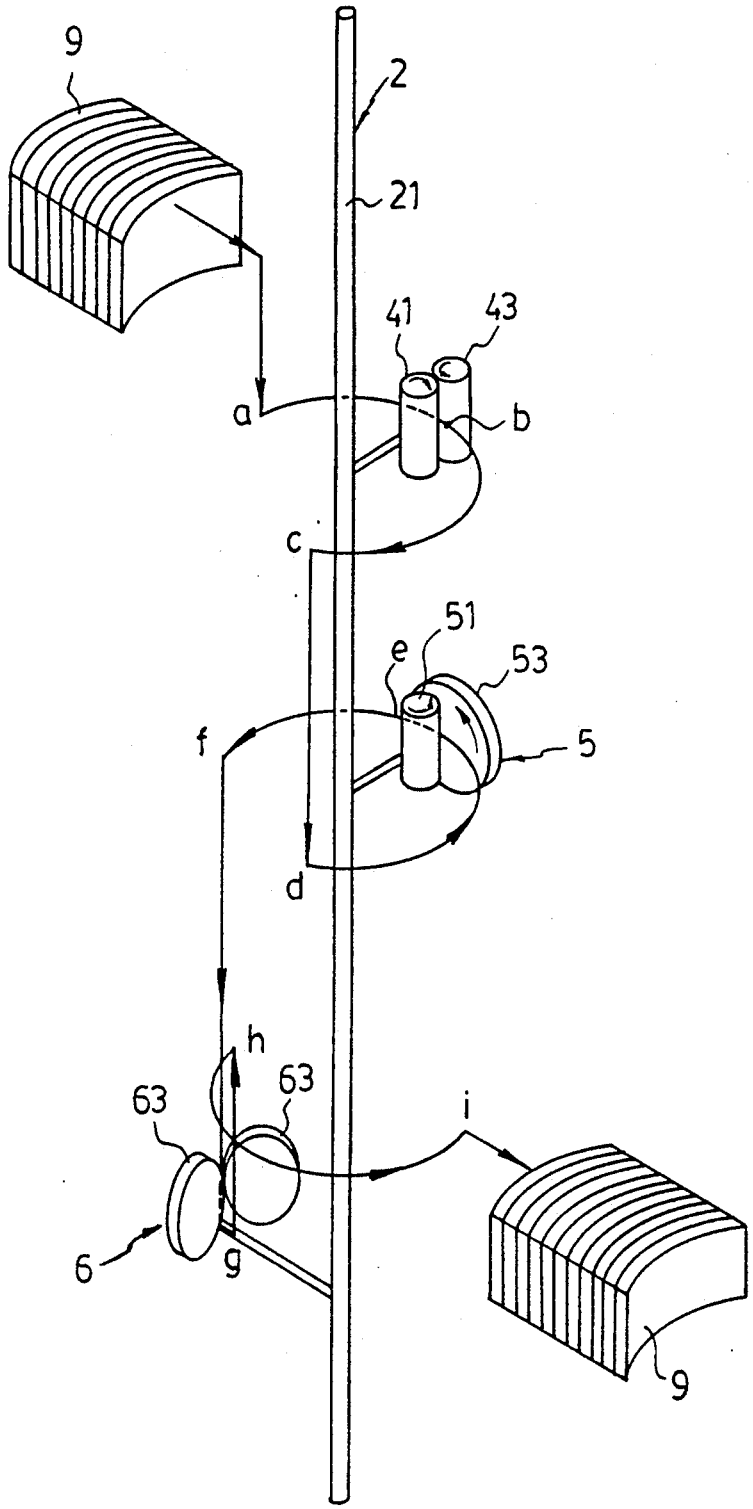
FIG. 5 is a simplified diagram illustrating the operation of the feeding and grinding devices of FIG. 2.

Referring to FIG. 5, the curved plates 9 which are provided on the carrier plates 35 are pushed toward the U-shaped notch 352 of the first side 351 of the carrier plate 35 upon actuation of the motor 326. The first lift device 34 transfers the curved plate 9 to the first predetermined position (a) on the second mounting frame 102. The first horizontal transferring device 7 transfers the curved plate 9 into the first grinding device 4 against biasing action of the first biasing member 46 of the same. The restoration force of the biasing member 46 presses the curved plate 9 against the first grinding member 41, so that a grinding operation is performed in order to provide a concaved face on the curved plate 9. The curved plate 9 is transferred to the second predetermined position (c) on the second mounting frame by pivotal action of the second horizontal transferring device.

The second lift device carries the curved plate 9 to the third predetermined position (d) on the third mounting frame. The third horizontal transferring device transfers the curved plate 9 from the third predetermined position (d) to the second grinding device 5. Since the second grinding and press members of the second grinding device are installed in a reverse manner, a grinding operation that provides a convex face on the curved plate 9 is preferred. The curved plate 9 is then transferred to the fourth predetermined position (f) by pivotal action of the fourth horizontal transferring device.

The two distal edges of the curved plate 9 are ground by the third grinding member 63 of the chamfering device upon reaching the load carrier plate 622 of the chamfering device when the curved plate is transferred to the load carrier plate 622 by vertical movement of the third lift device. During an upward movement of the third lift device, the third lift device stops half way at the fourth mounting frame 104, where the fifth horizontal transferring device transfer the finished curved plate 9 to a position on the fourth mounting frame 104 from which the air cylinder (not shown) pushes the curved plate 9 to an impelling mouth. The third lift device 8 further moves onwards to the third mounting frame 103 to fetch a succeeding curved plate 92.

A computerized control unit 10 is used in the present apparatus and is connected electrically to actuate and deactuate the retaining and push means of the feeding device 3, the actuating means of the first lift device, the actuating means and driving devices of the first and second horizontal transferring devices and the first grinding and first press members, the actuation means of the second lift device, the actuating means and driving devices of the third and fourth horizontal transferring devices and the second grinding and the second press members of the second grinding device, the actuating means of the third grind member and the retractable shaft of the chamfering device in a predetermined sequence.

Since grinding of the different portions of the curved plate 9 can be performed continuously, less manpower is required. Furthermore, since the grinding devices (4, 5, 6) employed in the preferred embodiment are disposed in the enclosed upright casing (1), the dust produced during the grinding operations can be collected from the enclosed casing (1) by a known art, such as vacuum suction device. The apparatus of the present invention thus provides a cleaner working environment. In addition, the apparatus is compact and requires a relatively small place to mount the same.

While a preferred embodiment has been described and illustrated, it will be apparent that many changes and modifications can be made in the general construction and arrangement of the present invention without departing from the scope and spirit thereof. Therefore, it is desired that the present invention be not limited to the exact disclosure but only to the extent of the appended claims.

I claim:

1. An apparatus for grinding continuously a curved plate which has a radius of curvature, said apparatus comprising:

a hollow upright casing having a top, a bottom, a first horizontal mounting frame adjacent to said top, a second horizontal mounting frame below said first mounting frame, a third horizontal mounting frame below said second mounting frame, a fourth horizontal mounting frame below said third mounting frame and a fifth horizontal mounting frame below said fourth mounting frame;

a synchronous adjusting mechanism including a worm journalled between said top and bottom;

a feeding device including a carrier plate which is mounted slidably on said first mounting frame and which has a first side adjacent to said worm and a second side opposite to said first side, an inverted U-shaped frame fixed uprightly on said carrier plate, means for retaining said curved plate vertically on said carrier plate and for pushing said curved plate toward said first side of said carrier plate, a first lift device for transferring said curved plate from said first side of said carrier plate to a first predetermined position of said second mounting frame and means for actuating said first lift device;

said feeding device further including a first worm gear which meshes with said worm and a first threaded shaft which has a first end that is connected to said first worm gear and a second end that engages threadedly said U-shaped frame so that said U-shaped frame and said carrier plate can move relative to said worm when said worm is rotated to rotate said first threaded shaft, said first side of said carrier plate being moved so as to be spaced from an axis of said worm by a first predetermined distance which is equal to said radius of curvature of said curved plate;

first and second horizontal transferring devices and a first grinding device mounted on said second mounting frame, said first horizontal transferring device transferring said curved plate from said first predetermined position of said second mounting frame to said first grinding device, said second horizontal transferring device transferring said curved plate from said first grinding device to a second predetermined position of said second mounting frame;

said first grinding device including an elongated first main support which has a first grinding member mounted rotatably thereon, a first secondary support which is mounted slidably on said elongated first main support and which has a first press member mounted rotatably thereon, and a first biasing member which biases said first press member toward said first grinding member and which maintains spacedly said first press member by a first clearance relative to said first grinding member, each of said first grinding member and said first press member having a center that lies on a longitudinal axis of said elongated first main support, said first grinding device further including a second worm gear which meshes with said worm and a second threaded shaft which extends parallel to said longitudinal length of said elongated first main support and which has a first end connected to a center of said second worm gear and a second end which engages threadedly a first mounting block, said elongated first main support being fixed to said first mounting block so that said elongated first main support moves together with said first mounting block along said second threaded shaft when said worm is rotated, said elongated first main support being moved such that a first length is formed between a middle of said first clearance and said axis of said worm, said first length being equal to said first predetermined distance;

means for rotating said first grinding member and said first press member;

said apparatus further including a second lift device fixed between said second and third mounting frames for transferring said curved plate from said second predetermined position of said second mounting frame to a third predetermined position of said third mounting frame;

means for actuating said second lift device;

third and fourth horizontal transferring devices and a second grinding device mounted on said third mounting frame, said third horizontal transferring device transferring said curved plate from said third predetermined position of said third mounting frame to said second grinding device, said fourth horizontal transferring device transferring said curved plate from said second grinding device to a fourth predetermined position of said third mounting frame;

said second grinding device including an elongated second main support that has a second press member mounted rotatably thereon, a second secondary support which is mounted slidably on said second main support and which has a second grinding member that is mounted rotatably thereon and a second biasing member that biases said second grinding member toward said second press member so as to retain spacedly said second grinding member by a second clearance relative to said second press member, each of said second press member and said second grinding member having a center which lies on a longitudinal axis of said second main support, said second grinding device further including a third worm gear which meshes with said worm and a third threaded shaft which extends parallel to said longitudinal length of said second main support and which has a first end that is connected to said third worm gear and a second end that engages a second mounting block threadedly, said second main support being fixed to said second mounting block so that said second main support moves together with said second mounting block along said third threaded shaft when said worm is rotated, said second main support being moved so that a second length which is equal to said first predetermined distance is formed between an intermediate point of said second clearance and said axis of said worm;

means for actuating said second press member and said second grinding member;

an impelling mechanism which is mounted on said fourth mounting frame and which includes a fifth horizontal transferring device and a push unit;

means for actuating said push unit;

a chamfering device mounted on said fifth mounting frame;

a third lift device mounted between said third and fifth mounting frames for transferring said curved plate from said fourth predetermined position of said third mounting frame to said chamfering device and for transferring said curved plate from said chamfering device to said fourth mounting frame and from said fourth mounting frame to said third mounting frame;

means for actuating said third lift device;

said chamfering device including a base disc which is fixed on said fifth mounting frame such that said worm extends through a center of said base disc, two elongated support plates, each having a front end pivoted to said base disc adjacent to said worm and a rear end connected detachably to said fifth mounting frame, thereby defining a first predetermined angle between said elongated support plates, said first predetermined angle corresponding to an angle between two distal edges of said curved plate, each of said support plates having a vertical rod support mounted slidably thereon, a holding member mounted slidably on each of said support plates between said vertical rod support and said rear end of each of said support plates, a retractable shaft interconnecting and driving said rod support and said holding member toward and away from each other, a guiding means formed on each of said support plates to permit said vertical rod support and said holding member to travel longitudinally on a respective one of said support plates, said holding member further having a vertical pivot post fixed thereon, a rotatable seat which is pivoted to said vertical pivot post and which has a third grinding member mounted rotatably thereon and means for holding releasably said rotatable seat on said holding member so that said third grinding member forms a second predetermined angle relative to said longitudinal axis of said elongated support plate, said chamfering device further including a load carrying plate extending perpendicularly from said vertical rod supports, said load carrying plate having a support face right below said fourth predetermined position of said third mounting frame, said chamfering device further including two fourth worm gears each of which is meshed with said worm and has a fourth threaded shaft which is parallel to a respective one of said support plates, each of said fourth threaded shaft having a first end connected to a respective said fourth worm gears and a second end connected threadedly to a third mounting block, said third mounting block being fastened to said vertical rod support below said load carrying plate such that said load carrying plate is spaced from said axis of said worm by said first predetermined distance;

means for actuating said third grinding member;

each of said first, second, third, fourth and fifth horizontal transferring devices including a fifth worm gear that meshes with said worm, a fifth threaded shaft that has a first end fixed to a center of said fifth worm gear and a second end, an elongated frame that has a front end adjacent to said worm, said second end of said fifth threaded shaft passing through said front end of said elongated frame, said elongated frame having a rear end which is slidably supported on a respective said mounting frame so that said fifth threaded shaft can pivot about said worm, said elongated frame further having a connecting rod interconnecting said front and rear ends of said elongated frame and which is paralleled to said fifth threaded shaft, first and second clamping members which are mounted slidably on said connecting rod and which cooperatively form a gap therebetween, a connecting member mounted slidably to said connecting rod and connected to said first clamping member, said fifth threaded shaft passing threadedly through said connecting member so that said connecting member can move along said connecting rod when said worm is rotated, and a driving device interconnecting and driving said first and second clamping members toward and away from each other, said connecting member being retained such that a third length is formed between a middle of said gap and said axis of the worm, said third length being equal to said first predetermined distance;

means for actuating each of said first, second, third, fourth and fifth horizontal transferring devices; and a control unit for actuating and deactuating said retaining and push means of said feeding device, said actuating means of said first, second and third lift devices, said actuating means of said first grinding member and said first press member, said actuating means of said second grinding member and said second press member, said actuating means of said push unit, said actuating means of said third grinding member, said retractable shaft of said chamfering device, said driving device and said actuating means of each of said first, second, third, fourth and fifth horizontal transferring devices in a predetermined sequence.

2. The apparatus as claimed in claim 1, wherein said carrier plate has a notch formed at said first side thereof, said feeding device further including means for placing a succeeding one of said curved plates in a vertical standing position adjacent to a preceding said curved plate that is disposed adjacent to said notch.

3. The apparatus as claimed in claim 1, wherein said apparatus further includes a detection unit which detects a protruding section of said curved plate by said first lift device, said detection unit including a push roller which pushes said curved plate to expose a section which is greater than said protruding section upon detection that said protruding section of said curved plate is smaller than a predetermined size.

4. The apparatus as claimed in claim 1, wherein said means for holding releasably said rotatable seat includes an adjustable screw which fastens said rotatable seat on said holding member so as to dispose said third grinding member at said second predetermined angle relative to said longitudinal length of said elongated support plate.

5. The apparatus as claimed in claim 1, wherein said first and second grinding devices further include two air cylinders mounted on respective one of said first and second main support, each of said air cylinders having a piston arm that carries an L-shaped plate, said piston arms extending out of a respective one of said air cylinders so as to dispose said L-shaped plate adjacent to respective one of said first and second clearances and retracting therefrom upon actuating, said longitudinal axis of said first and second main support dividing a respective one of said first and second main supports into a first side, said first and second grinding device respectively expelling said curved plate into said respective first side, each of said air cylinders being mounted on said first side of said longitudinal axis.

* * * * *